US012303966B1

(12) United States Patent
Liang et al.

(10) Patent No.: US 12,303,966 B1
(45) Date of Patent: May 20, 2025

(54) MOLDING MACHINES FOR FLEXIBLE PRODUCTION OF REBARS OF BOTTOM, WEB, AND TOP PLATES OF PRECAST SMALL BOX GIRDERS AND METHODS FOR USING THEREOF

(71) Applicants: CHINA RAILWAY NO. 4 ENGINEERING GROUP CO., LTD, Anhui (CN); CHUANGZHI ENGINEERING TECHNOLOGY BRANCH OF CHINA RAILWAY NO. 4 ENGINEERING GROUP CO., LTD, Anhui (CN)

(72) Inventors: Chao Liang, Hefei (CN); Shihong Ding, Hefei (CN); Ze Xu, Hefei (CN); Liqiong Luo, Hefei (CN); Shiguang Lai, Hefei (CN); Lihong Fu, Hefei (CN); Peng Wang, Hefei (CN); Jiangming Mao, Hefei (CN); Shibao Zhang, Hefei (CN); Song Deng, Hefei (CN); Younian Tong, Hefei (CN)

(73) Assignees: CHINA RAILWAY NO. 4 ENGINEERING GROUP CO., LTD, Hefei (CN); CHUANGZHI ENGINEERING TECHNOLOGY BRANCH OF CHINA RAILWAY NO. 4 ENGINEERING GROUP CO., LTD, Hefei (CN)

( * ) Notice: Subject to any disclaimer, the term of this patent is extended or adjusted under 35 U.S.C. 154(b) by 0 days.

(21) Appl. No.: 18/885,553

(22) Filed: Sep. 13, 2024

(30) Foreign Application Priority Data

Mar. 19, 2024 (CN) ..... 202410308787.1

(51) Int. Cl.
*B21F 27/20* (2006.01)
*B21F 23/00* (2006.01)
*B21F 27/10* (2006.01)

(52) U.S. Cl.
CPC ..... *B21F 27/20* (2013.01); *B21F 23/00* (2013.01); *B21F 27/10* (2013.01)

(58) Field of Classification Search
CPC ..... B21F 23/00; B21F 23/05; B21F 27/10
(Continued)

(56) References Cited

U.S. PATENT DOCUMENTS 2,401,319 A * 6/1946 Roemer ..... B21F 27/02 140/112

FOREIGN PATENT DOCUMENTS

CN 104786368 A 7/2015
CN 206868989 U 1/2018
(Continued)

OTHER PUBLICATIONS

English translate (CN206981668U), retrieved date Oct. 16, 2024.*
(Continued)

*Primary Examiner* — Mohammed S. Alawadi
(74) *Attorney, Agent, or Firm* — Porus IP LLC

(57) ABSTRACT

The present disclosure provides a molding machine for flexible production of a rebar of bottom, web, and top plates of a precast small box girder, comprising a molding mainframe and a movable gantry welder disposed on an outlet end of the molding mainframe. The molding mainframe includes a frame, two synchronous lifters, a vertical movable sliding table, a plurality of upper support plates, and a plurality of comb-like support plates. A plurality of spot welding assemblies are disposed on an upper side and a lower side of an outlet end of the frame, a straightening rebar receiving assembly is mounted on the lower side and two
(Continued)

bending assemblies are mounted on a left side and a right side of the outlet end of the frame, and a straightening rebar feeding assembly is disposed between the straightening rebar receiving assembly and the frame.

9 Claims, 10 Drawing Sheets

(58) Field of Classification Search
USPC ..... 140/17, 111–113
See application file for complete search history.

(56) References Cited

FOREIGN PATENT DOCUMENTS

| | | | | |
|---|---|---|---|---|
| CN | 206981668 U | * | 2/2018 | ..... B23K 31/00 |
| CN | 207358026 U | | 5/2018 | |
| CN | 110405386 A | | 11/2019 | |
| CN | 112045100 A | | 12/2020 | |
| CN | 112045440 A | | 12/2020 | |
| CN | 112207213 A | | 1/2021 | |
| CN | 114570864 A | | 6/2022 | |
| CN | 117245038 A | | 12/2023 | |
| CN | 117620034 A | | 3/2024 | |
| GB | 933300 A | | 8/1963 | |
| JP | 2018069329 A | | 5/2018 | |
| KR | 101958214 B1 | | 3/2019 | |
| KR | 20200017439 A | | 2/2020 | |
| WO | 2006119595 A1 | | 11/2006 | |

OTHER PUBLICATIONS

First Office Action in Chinese Application No. 202410308787.1 mailed on May 6, 2024, 15 pages.
Notification to Grant Patent Right for Invention in Chinese Application No. 202410308787.1 mailed on May 17, 2024, 5 pages.

* cited by examiner

MOLDING MACHINES FOR FLEXIBLE PRODUCTION OF REBARS OF BOTTOM, WEB, AND TOP PLATES OF PRECAST SMALL BOX GIRDERS AND METHODS FOR USING THEREOF

CROSS-REFERENCE TO RELATED APPLICATION

The present disclosure claims priority to Chinese application No. 202410308787.1, filed on Mar. 19, 2024, the entire contents of which are incorporated herein by reference.

TECHNICAL FIELD

The present disclosure relates to the technical field of prefabrication technology of reinforcing mesh, and in particular, to a molding machine for flexible production of a rebar of bottom, web, and top plates of a precast small box girder.

BACKGROUND

When constructing structures such as bridges or tunnels, reinforcing mesh is often used to strengthen the concrete. The reinforcing mesh is a grid-like structure made by weaving steel bars in a crisscross pattern, which provides strong tensile and compressive support within the concrete, effectively enhancing its strength and durability.

Small box girders require the use of three-dimensional reinforcing mesh, which is formed by spot-welding components such as double layers of longitudinal bars, bent hoop bars, and stiffeners, resulting in a structure with considerable strength.

Current welding production equipment for reinforcing mesh is typically less integrated, and forming three-dimensional reinforcing mesh requires simultaneous forming of hoop bars while feeding in the longitudinal bars. The hoop bars and longitudinal bars need to be welded and fixed at their intersection points, and a part of the welding process is completed during each material feeding operation. This makes it difficult to meet the demands for integrated and continuous forming of three-dimensional reinforcing mesh.

Based on this, there is a need to provide a molding machine for flexible production of a rebar of bottom, web, and top plates of a precast small box girder.

SUMMARY

One or more embodiments of the present disclosure may provide a molding machine for flexible production of a rebar of bottom, web, and top plates of a precast small box girder. The molding machine may comprise a molding mainframe and a movable gantry welder disposed on an outlet end of the molding mainframe. The molding mainframe may include a frame, two synchronous lifters, a vertical movable sliding table, a plurality of upper support plates, and a plurality of comb-like support plates. An inlet end of the frame may be provided with a longitudinal bar feeding assembly for guiding a longitudinal bar arranged in a standardized manner, the two synchronous lifters may be fixedly mounted on an upper side of an outlet end of the frame, the vertical movable sliding table may be connected with the frame through a guide rail sliding block structure in a position-limiting and sliding manner, and an output end of the two synchronous lifters may be fixedly connected with the vertical movable sliding table, the plurality of upper support plates may be fixedly mounted on the vertical movable sliding table at equal spacing, and the plurality of comb-like support plates may be fixedly mounted on a lower side of the outlet end of the frame. An upper side and a lower side of the outlet end of the frame may be provided with a plurality of spot welding assemblies for welding a portion of cross nodes of hoop bars and longitudinal bars, and the plurality of spot welding assemblies may be connected with the vertical movable sliding table and the frame, respectively, and a straightening rebar receiving assembly may be mounted on the lower side of the outlet end of the frame, and a straightening rebar feeding assembly may be mounted between the straightening rebar receiving assembly and the frame, and a left side and a right side of the frame may be provided with a bending assembly, respectively. Two row welding assemblies for welding all cross nodes of the hoop bars and the longitudinal bars may be disposed between the molding mainframe and the movable gantry welder, the two row welding assemblies may be connected with the plurality of upper support plates and used for welding the longitudinal bars of an upper layer and a lower layer, respectively. The longitudinal bar feeding assembly may include a plurality of pneumatic clamps, a side guiding plate, and a threading guiding plate, two rows of pneumatic clamps may be fixedly mounted on an upper side and a lower side of the inlet end of the frame, respectively, the two rows of pneumatic clamps may be configured to clamp and fix the longitudinal bars of the upper layer and the lower layer that are fed into the longitudinal bar feeding assembly, respectively. The threading guiding plate may be fixedly mounted on a lower end of the plurality of upper support plates, the threading guiding plate may be provided with a plurality of through-holes used for positioning the longitudinal bars of the upper layer, and the longitudinal bars of the lower layer may be directly supported by the frame. The lower side of the inlet end of the frame may be fixedly provided with a plurality of groups of side guiding structures for guiding the longitudinal bars of the lower layer, each group of the side guiding structures being made of two side guiding plates, an inlet end of the two side guiding plates being provided with an opening that facilitates entry of the longitudinal bars of the lower layer.

In some embodiments, the straightening rebar receiving assembly may include a straightening rebar receiving bracket, a receiving assembly, and a positioning assembly. The straightening rebar receiving bracket being fixedly mounted on the lower side of the outlet end of the frame, one side of the straightening rebar receiving bracket may be provided with the receiving assembly, and the other side of the straightening rebar receiving bracket may be provided with the positioning assembly.

In some embodiments, the straightening rebar receiving assembly may include a plurality of single wire feeding wheels, a plurality of V-shaped guiding bars, a chain driving structure, and a plurality of sprockets. The plurality of single wire feeding wheels may be rotationally mounted on the straightening rebar receiving bracket along a length direction of the straightening rebar receiving bracket, the plurality of V-shaped guiding bars that are fixedly connected with the straightening rebar receiving bracket may be disposed between the plurality of single wire feeding wheels. A side surface of each of the plurality of single wire feeding wheels may be provided with one of the plurality of sprockets, the chain driving structure may be mounted on the straightening rebar receiving bracket, and a chain of the chain driving structure may be engaged with the plurality of sprockets.

In some embodiments, the positioning assembly may include a positioning stopping block, a servo linear module, and a V-shaped guiding plate. The servo linear module may be fixedly connected with the straightening rebar receiving bracket, the V-shaped guiding plate may be fixedly mounted on the servo linear module, and the positioning stopping block may be fixedly mounted on a sliding plate of the servo linear module.

In some embodiments, the bending assembly may include a transverse servo moving sliding table, a servo reduction motor, a bending shaft, and a bending mold. The transverse servo moving sliding table may be fixedly connected with the frame, the servo reduction motor may be fixedly mounted on a sliding plate of the transverse servo moving sliding table, the bending shaft may be fixedly mounted on an output end of the servo reduction motor, and the bending mold may be fixedly mounted on the bending shaft.

In some embodiments, each of the plurality of spot welding assemblies may include a first cylinder, a connecting block, a second cylinder, a fixed spot welding block, and a movable spot welding block. The first cylinder may be fixedly connected with the vertical movable sliding table or the frame, the connecting block may be fixedly mounted at an output end of the first cylinder, the connecting block may be fixedly mounted with the second cylinder, and the fixed spot welding block may be fixedly mounted at an output end of the second cylinder, the movable spot welding block may be fixedly connected with the frame, and each of the plurality of spot welding assemblies may be powered by a separate transformer.

In some embodiments, the movable gantry welder may include a first longitudinal servo moving mechanism, a gantry frame, a second longitudinal servo moving mechanism, a plurality of wire-clamping assemblies, and a mounting chassis. The first longitudinal servo moving mechanism may be fixedly mounted on an inlet end of the mounting chassis, the second longitudinal servo moving mechanism may be fixedly mounted on an outlet end of the mounting chassis, the gantry frame may be fixedly mounted on a sliding plate of the first longitudinal servo moving mechanism, and the plurality of wire-clamping assemblies may be fixedly mounted at equal spacing on a sliding plate of the second longitudinal servo moving mechanism uniformly.

In some embodiments, each of the two row welding assemblies may include a movable row welding block, a fixed row welding block, a vertical variant assembly, a transverse variant assembly, and a welding cylinder. The fixed row welding block may be fixedly connected with a right end of the upper support plate; the vertical variant assembly and the transverse variant assembly may be fixedly mounted on the gantry frame, and the welding cylinder may be fixedly connected with a mobile end of the vertical variant assembly and a mobile end of the transverse variant assembly and may be equally spaced apart. An output end of the welding cylinder may be fixedly provided with the fixed row welding block; and the fixed row welding block may be separated into a plurality of segments to perform a welding operation on a plurality of welding joints in different regions.

One of the embodiments of the present disclosure provides a method for using a molding machine for flexible production of a rebar of bottom, web, and top plates of a precast small box girder, comprising following operations:

Operation 1: a feeding mechanism transporting longitudinal bars of an upper layer and a lower layer arranged in a standardized manner to a frame, two rows of pneumatic clamps clamping and fixing the longitudinal bars of the upper layer and the lower layer, the longitudinal bars of the upper layer penetrating via a plurality of through-holes on a threading guiding plate and being supported and limited by the threading guiding plate, and the longitudinal bars of the lower layer being directly supported by the frame and being limited by the pneumatic clamps.

Operation 2: a chain driving structure driving a plurality of single wire feeding wheels to rotate through a plurality of sprockets, and driving the straightening rebar which is cut off by a straightening sizer to be transported under limiting of a V-shaped guiding bar and a V-shaped guiding plate until the straightening rebar is blocked by the positioning stopping block;

Operation 3: a third cylinder and a fourth cylinder driving a receiving plate to receive the straightening rebar on the plurality of single wire feeding wheels, and then transporting the straightening rebar to a bending working-station;

Operation 4: after the straightening rebar is in place, the servo reduction motor driving a bending shaft to rotate, and the bending shaft bending the straightening rebar inwardly through the bending mold, and then a transverse servo moving sliding table driving the bending assembly to move inwardly to perform a second bending on the straightening rebar, so that the straightening rebar may be bent and shaped into a closed rectangle to form a hoop bar structure;

Operation 5: when the straightening rebar is bent, an output end of the second cylinder contracting, so that the fixed spot welding block is in an avoidance state, when the hoop bar structure is formed, the second cylinder driving a fixed spot welding block to reset, and the first cylinder driving the fixed spot welding block to be close to the movable spot welding block to perform a spot welding operation on a portion of cross nodes of hoop bars and longitudinal bars;

Operation 6: a welding cylinder driving a movable row welding block to be close to a fixed row welding block, and performing a welding operation on the all cross nodes of the longitudinal bars and the hoop bars; and Operation 7: with each welding operation, a wire-clamping assembly driving a formed mesh to move forward one operation, then a clamping jaw of the wire-clamping assembly moving vertically downward to avoid the formed mesh and returning to a position of a previous operation, and after a next welding operation, the wire-clamping assembly driving the formed mesh to move forward one operation and progressively advancing the formed mesh out; ultimately, a finished product being cither flipped or horizontally transferred out.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering denotes the same structure, wherein.

LABELS IN FIGURES REPRESENT

Figure 1:
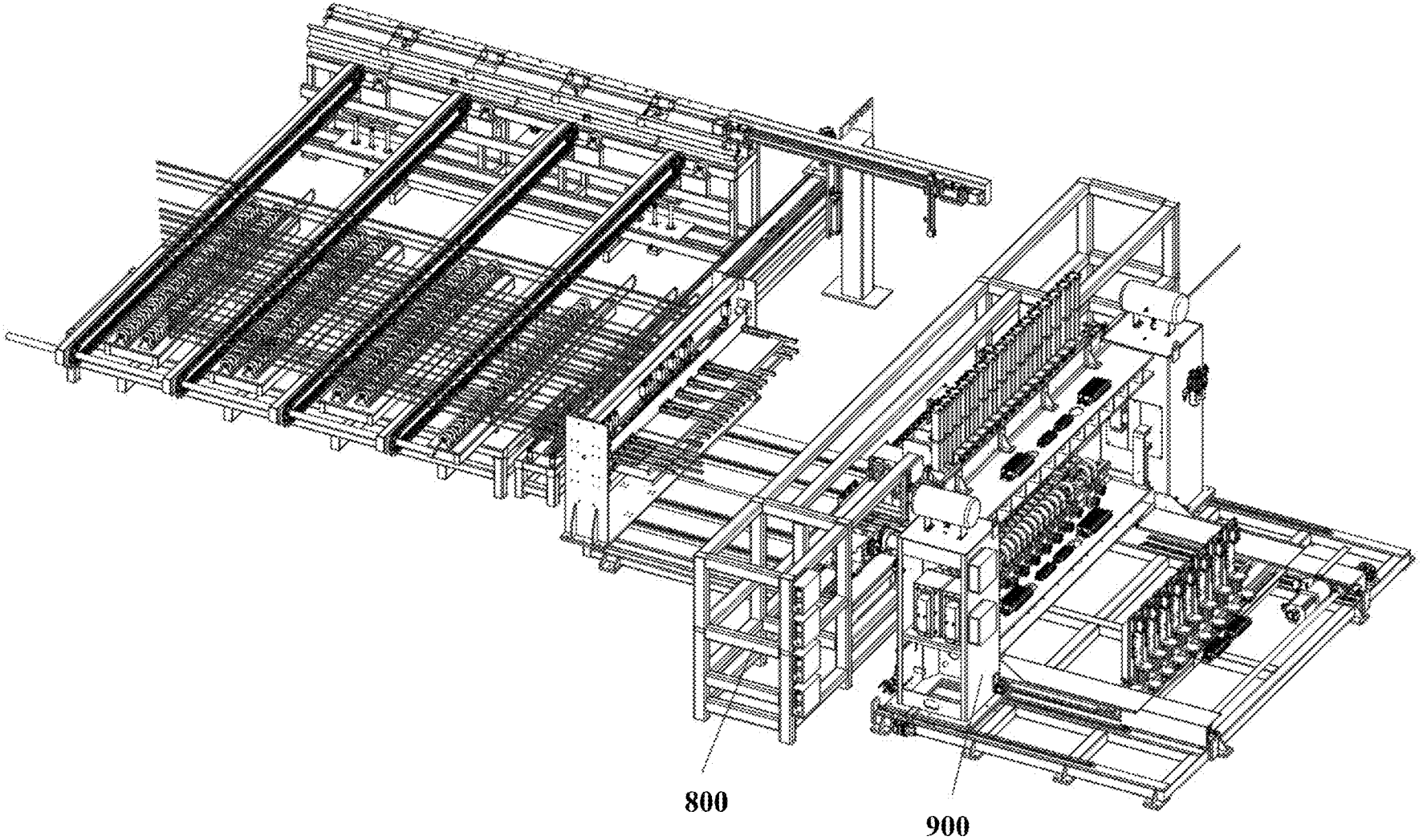
FIG. 1 is a schematic diagram illustrating an overall structure of a flexible production line of a rebar according to some embodiments of the present disclosure.

800, molding mainframe; 801, frame; 802, synchronous lifter; 803, vertical movable sliding table; 804, upper support plate; 805, comb-like support plate; 810, longitudinal bar feeding assembly; 811, pneumatic clamp; 812, side guiding plate; 813, threading guiding plate; 820, straightening rebar receiving assembly; 821, straightening rebar receiving bracket; 822, single wire feeding wheel; 823, V-shaped guiding bar; 824, chain driving structure; 825, sprocket; 826, positioning stopping block; 827, servo linear module; 828, V-shaped guiding plate; 830, straightening rebar feeding assembly; 831, third cylinder; 832, fourth cylinder; 833, receiving plate; 840, bending assembly; 841, transverse servo moving sliding table; 842, servo reduction motor; 843, bending shaft; 844, bending mold; 850, spot welding assembly; 851, first cylinder; 852, connecting block; 853, second cylinder; 854, fixed spot welding block; 855, movable spot welding block; 900, movable gantry welder; 901, first longitudinal servo moving mechanism; 902, gantry frame; 903, second longitudinal servo moving mechanism; 904, wire-clamping assembly; 905, mounting chassis; 910, row welding assembly; 911, movable row welding block; 912, fixed row welding block; 913, vertical variant assembly; 914, transverse variant assembly; and 915, welding cylinder.

DETAILED DESCRIPTION

In order to more clearly illustrate the technical solutions of some embodiments of the present disclosure, a brief introduction to the drawings that need to be used in the description of the embodiments will be given below. It is obvious that the drawings mentioned in the following description are only examples or embodiments of the present disclosure. For those skilled in the art, without creative labor, the present disclosure can also be applied to other similar scenarios based on these drawings. Unless obviously obtained from the context or the context illustrates otherwise, the same numeral in the drawings refers to the same structure or operation.

It should be understood that the terms "system", "device", "unit", and/or "module" used herein are used to distinguish different components, elements, parts, sections, or assemblies at different levels. However, if other words can achieve the same purpose, they can be replaced by other expressions.

Unless the context clearly indicates otherwise, the words "one", "a", "an", /or "the" do not specifically refer to the singular, and can also include the plural. Generally, the terms "including" and "comprising" indicate only the inclusion of clearly identified steps and elements. The method or apparatus may also include other steps or elements, as these steps and elements do not constitute an exclusive list.

Further description of the present disclosure will be made in connection with some embodiments below.

Figure 3:
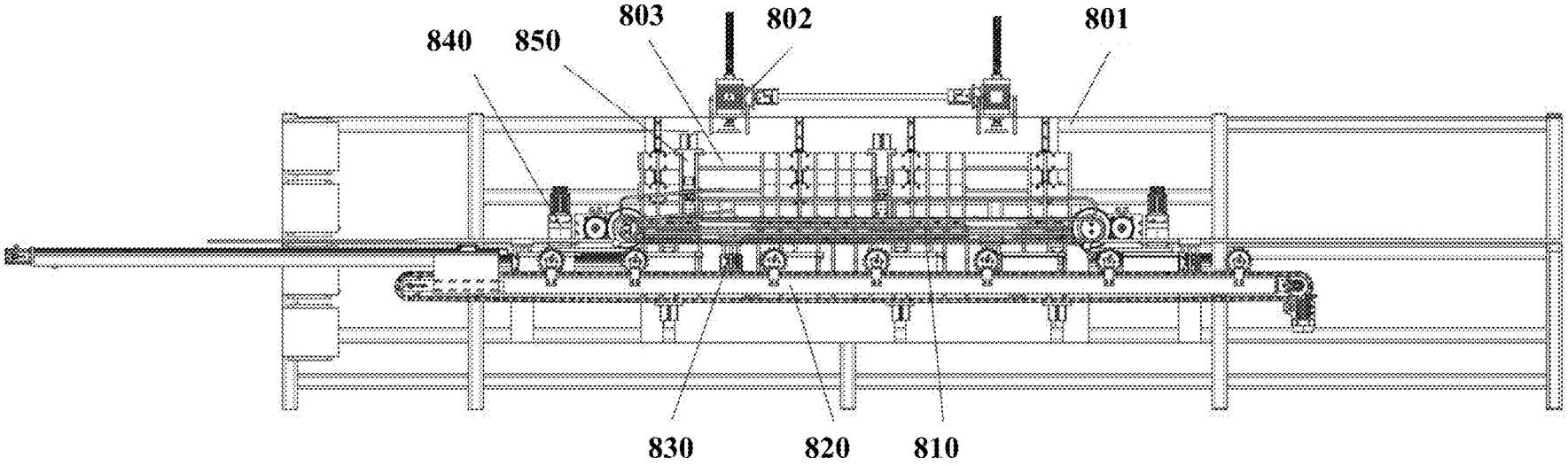
FIG. 3 is a schematic diagram illustrating an exemplary front view of a molding mainframe according to some embodiments of the present disclosure.

References to "left", "right", "front", "back", "top", and "bottom" in the following descriptions are oriented in the direction of the viewing angle of the front view (FIG. 3).

Figure 2:
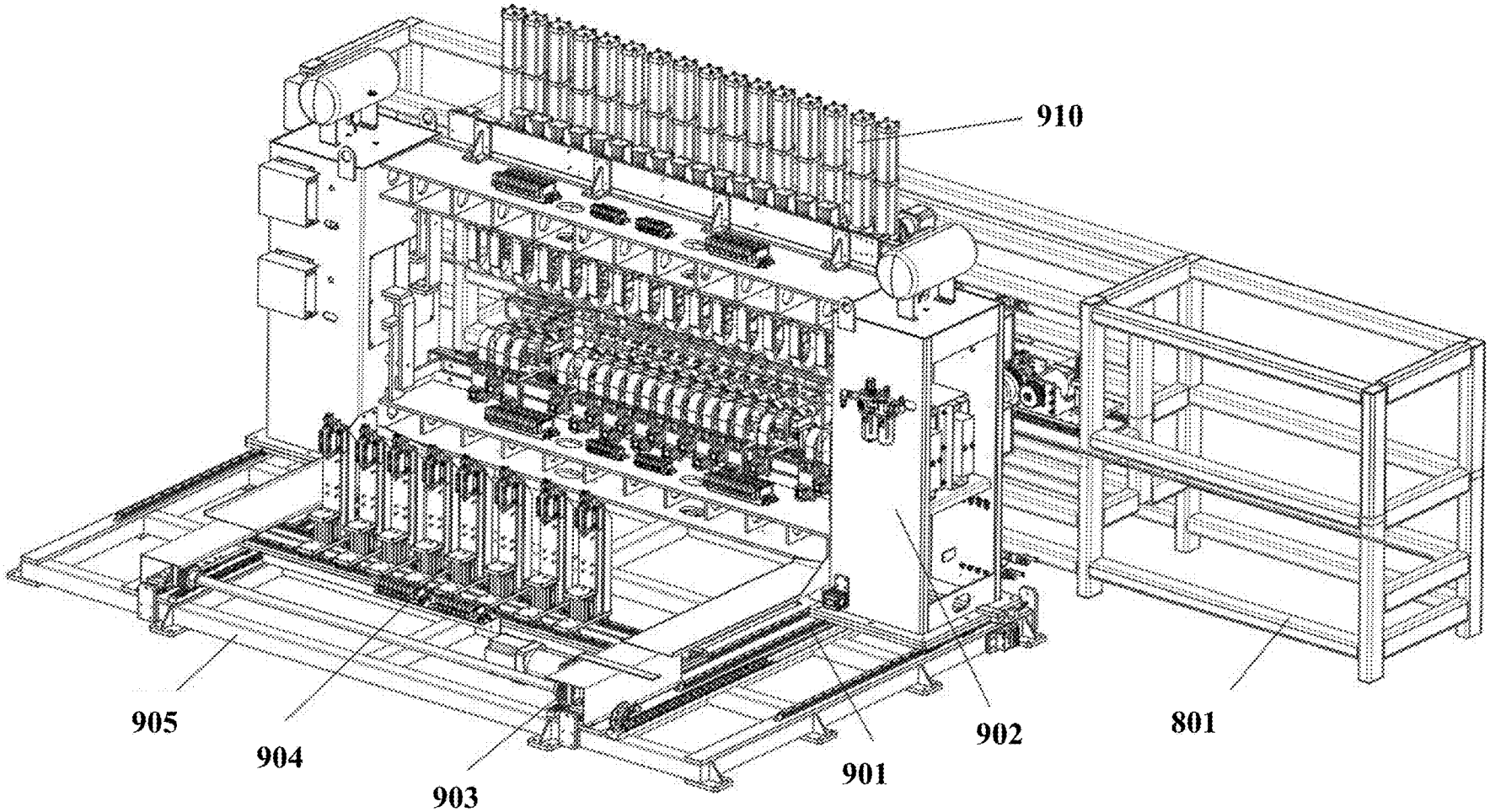
FIG. 2 is a schematic diagram illustrating an exemplary structure of a molding machine for flexible production of a rebar of bottom, web, and top plates of a precast small box girder according to some embodiments of the present disclosure.
Figure 4:
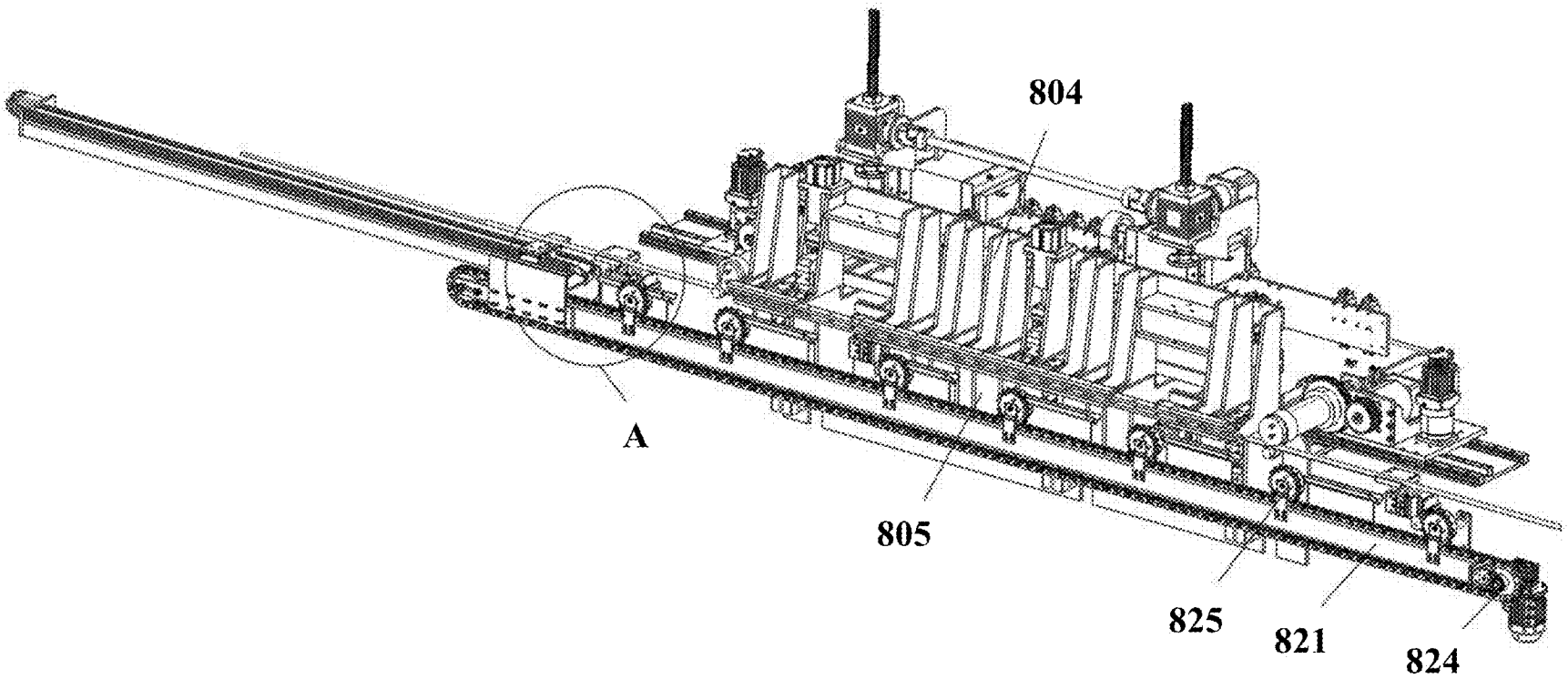
FIG. 4 is a schematic diagram I illustrating an exemplary structure of a molding mainframe according to some embodiments of the present disclosure.
Figure 5:
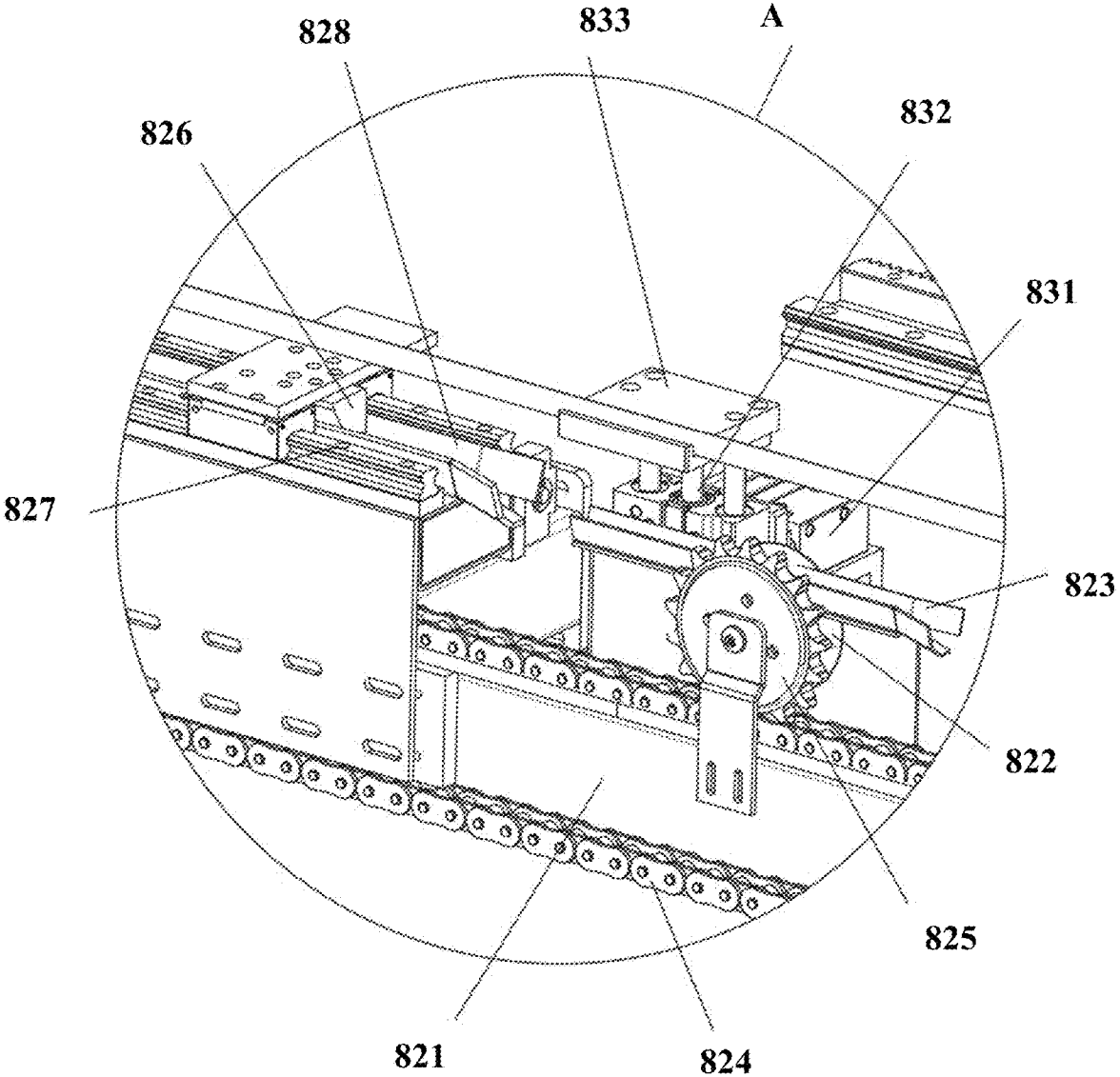
FIG. 5 is a diagram illustrating an enlarged view of a region A in FIG. 4.

FIG. 1 is a schematic diagram illustrating an overall structure of a rebar flexible production line according to some embodiments of the present disclosure. FIG. 2 is a schematic diagram illustrating an exemplary structure of a molding machine for flexible production of a rebar of bottom, web, and top plates of a precast small box girder according to some embodiments of the present disclosure. FIG. 3 is a schematic diagram illustrating a front view of a molding mainframe according to some embodiments of the present disclosure. FIG. 4 is a schematic diagram I illustrating an exemplary structure of a molding mainframe according to some embodiments of the present disclosure. FIG. 5 is a diagram illustrating an enlarged view of a region A in FIG. 4.

A box girder may be a type of girder in bridge engineering, which is hollow inside and has flanges on upper sides, similar to a box. Bottom, web, and top plate rebars refer to stressed rebars of a bottom plate, a web plate, and a top plate. The stressed rebars of the top plate and the bottom plate refer to longitudinal bars, playing a role in bending resistance, and the stressed rebar of the web plate refers to a hoop bar, playing a role in shear resistance. Flexible production refers to a new production mode that arises in response to the demand for mass customization.

Referring to FIG. 1 and FIG. 2 of the present disclosure, in some embodiments, a molding machine for flexible production of a rebar of bottom, web, and top plates of a precast small box girder (hereinafter referred to as a molding machine) may include a molding mainframe 800 and a movable gantry welder 900 disposed on an outlet end of the molding mainframe 800.

The molding mainframe 800 may be a main structure of the molding machine.

In some embodiments, the molding mainframe 800 may include a frame 801, two synchronous lifters 802, a vertical movable sliding table 803, a plurality of upper support plates 804, and a plurality of comb-like support plates 805, as illustrated in FIG. 3 and FIG. 4.

The frame 801 refers to a structure that supports and secures the molding mainframe 800. In some embodiments, an inlet end of the frame 801 may be located on a rear side of the outlet end.

In the present embodiment, a longitudinal bar feeding assembly 810 may be disposed at the inlet end of the frame 801 for guiding a longitudinal bar arranged in a standardized manner. The longitudinal bar feeding assembly 810 may be an assembly configured to arrange and guide a to-be-processed longitudinal bar to allow the longitudinal bar to proceed to a subsequent processing process.

In some embodiments, the two synchronous lifters 802 may be fixedly mounted on an upper side of an outlet end of the frame 801. The synchronous lifter 802 may be an assembly for adjusting a height of a row welding assembly 910.

The vertical movable sliding table 803 may be a sliding table for supporting vertical movement of the two synchronous lifters 802. In some embodiments, the vertical movable sliding table 803 may be connected with the frame 801 via a guide rail sliding block structure in a position-limiting and sliding manner, and output ends of the two synchronous lifters 802 may be fixedly connected with the vertical movable sliding table 803.

In some embodiments, a plurality of upper support plates 804 may be fixedly mounted at equal spacing on the vertical movable sliding table 803, and the plurality of comb-like support plates 805 may be fixedly mounted on a lower side of the outlet end of the frame 801. The upper support plate 804 may be a structure for connecting or carrying a portion in the molding machine.

In some embodiments, a plurality of spot welding assemblies 850 may be disposed on the upper side and the lower side of the outlet end of the frame 801 and may be connected with the vertical movable sliding table 803 and the frame 801, respectively. The spot welding assembly 850 may be an assembly used to weld a portion of cross nodes of hoop bars and longitudinal bars. The portion of cross nodes that need to be welded by the plurality of spot welding assemblies 850 may be selected according to actual needs. For example, the plurality of spot welding assemblies 850 may weld at alternating cross nodes of the hoop bars and the longitudinal bars to achieve preliminary fixation. More information about the spot welding assembly 850 can be found in the relevant description below.

In some embodiments, a straightening rebar receiving assembly 820 may be mounted on the lower side of the outlet end of the frame 801, and a straightening rebar feeding assembly 830 may be disposed between the straightening rebar receiving assembly 820 and the frame 801. The straightening rebar receiving assembly 820 may be an assembly for receiving a cut straightening rebar and positioning and guiding the cut straightening rebar, and the straightening rebar feeding assembly 830 may be an assembly for transmitting the straightening rebar to a bending working-station. More information about the straightening rebar receiving assembly 820, the straightening rebar feeding assembly 830, and the bending working-station can be found in the relevant description below.

In some embodiments, a bending assembly 840 may be mounted on a left side and a right side of the frame 801. The bending assembly 840 may be an assembly for bending a rebar. More information about the bending assembly 840 can be found in the relevant description below.

The movable gantry welder 900 may be a machine for welding the rebar.

In some embodiments, the row welding assembly 910 may be disposed between the molding mainframe 800 and the movable gantry welder 900. The row welding assembly 910 may be connected with the plurality of upper support plates 804, and the row welding assembly 910 may be divided into two groups, respectively, for welding longitudinal bars of an upper layer and a lower layer. The row welding assembly 910 may be an assembly configured to weld all cross nodes of the hoop bars and the longitudinal bars. For specifics, please refer to the relevant description below.

In some embodiments of the present disclosure, a spacing between longitudinal bars of an upper layer and a lower layer of different models of reinforcing mesh may be different, and a spacing between neighboring longitudinal bars of a same layer may also be different. The two synchronous lifters 802 may drive the upper support plate 804 to move along a vertical direction through the vertical movable sliding table 803 to adjust the height of the row welding assembly 910, which allows the molding machine to be adaptable to different models of reinforcing mesh. The feeding mechanism may transmit the longitudinal bars of the upper layer and the lower layer arranged in a standardized manner to the frame 801, and with the assistance of the longitudinal bar feeding assembly 810, the longitudinal bars may not deviate during a displacement process, thus ensuring the processing accuracy of the reinforcing mesh.

In some embodiments, the straightening rebar cut by a straightening sizer may be fed into the straightening rebar receiving assembly 820. Through the straightening rebar receiving assembly 820, the straightening rebar may be accurately positioned and guided. Subsequently, the longitudinal bar feeding assembly 810 may transmit the straightening rebar to the bending working-station, and the bending assembly 840 may bend the straightening rebar to form the hoop bar. The spot welding assembly 850 may weld the portion of cross nodes of the hoop bars and the longitudinal bars to initially form the reinforcing mesh. After an initially-shaped reinforcing mesh may be transmitted to the movable gantry welder 900, the row welding assembly 910 may weld all cross nodes of the hoop bars and the longitudinal bars. Each welding operation may cause the mesh to move forward one operation, until the whole mesh is welded. After welding is finished, a finished product may be turned over or moved out by panning, which is convenient for lifting.

In some embodiments of the present disclosure, through integrated design of the molding mainframe 800, a feeding process, a bending process, and a welding process of the hoop bars are centralized in a single device. Through cooperation between the molding mainframe 800 and the movable gantry welder 900, an automated flexible production process of precast reinforcing mesh can be achieved. Integrating the reinforcing mesh into a single piece makes the production process of three-dimensional reinforcing mesh more efficient, improves the stability of component production, reduces production costs, and meets the needs for multi-specification, safe, efficient, and reliable production.

Figure 6:
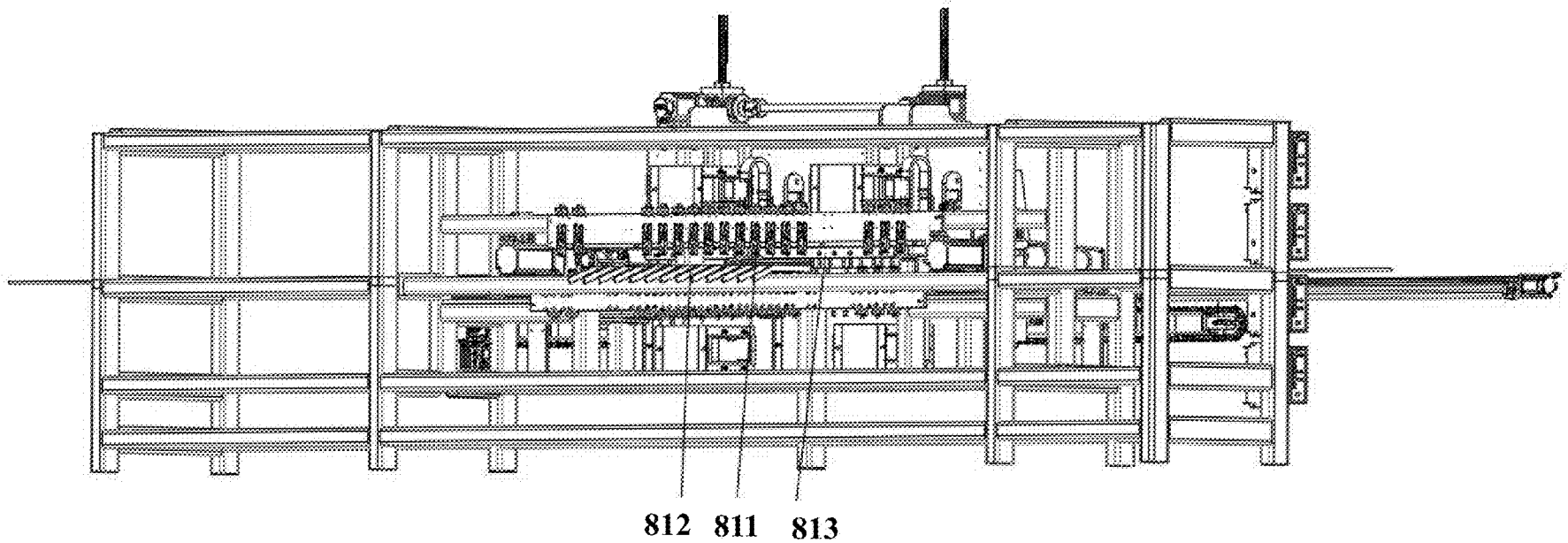
FIG. 6 is a schematic diagram II illustrating an exemplary structure of a molding mainframe according to some embodiments of the present disclosure.

FIG. 6 is a schematic diagram II illustrating an exemplary structure of a molding mainframe according to some embodiments of the present disclosure.

As shown in FIG. 6, in some embodiments, the longitudinal bar feeding assembly 810 may include a plurality of pneumatic clamps 811, a side guiding plate 812, and a threading guiding plate 813.

The pneumatic clamp 811 may be an assembly for clamping and fixing a longitudinal bar. In some embodiments, two rows of pneumatic clamps 811 may be fixedly mounted on an upper side and a lower side of an inlet end of the frame 801, and the two rows of pneumatic clamps 811 may be used to clamp and fix longitudinal bars of an upper layer and a lower layer that are being fed, respectively.

The threading guiding plate 813 may be an assembly for positioning and guiding a rebar. In some embodiments, the threading guiding plate 813 may be fixedly mounted at a lower end of the upper support plate 804, and the threading guiding plate 813 may be provided with a plurality of through holes for locating the longitudinal bars of the upper layer, and the longitudinal bars of the lower layer may be directly supported by the frame 801.

In some embodiments, a plurality of groups of side guiding structures for guiding the longitudinal bars of the lower layer may be fixedly mounted on the lower side of the inlet end of the frame 801, and each group of side guiding structures may include two side guiding plates 812, and an inlet end of the side guiding plate 812 may be provided with an opening that facilitates the entry of the longitudinal bar. The side guiding plate 812 may be an assembly for guiding the rebar.

In some embodiments of the present disclosure, the feeding mechanism may transmit the longitudinal bars of the upper layer and the lower layer arranged in a standardized manner to the frame 801, and the two rows of pneumatic clamps 811 may clamp the longitudinal bars of the upper layer and the lower layer, and the longitudinal bars of the upper layer may pierce through the plurality of through-holes on the threading guiding plate 813 and be supported and limited by the threading guiding plate 813; and the longitudinal bars of the lower layer may be directly supported by the frame 801 and limited by the pneumatic clamp 811. The longitudinal bars of the upper layer and the lower layer may be supported and limited, ensuring that the longitudinal bar does not deviate during the movement and ensuring the molding accuracy of the reinforcing mesh.

Returning to FIG. 4 and FIG. 5, in some embodiments, the straightening rebar receiving assembly 820 may include a straightening rebar receiving bracket 821, a receiving assembly, and a positioning assembly. The straightening rebar receiving bracket 821 may be fixedly mounted on a lower side of an outlet end of the frame 801, one side of the straightening rebar receiving bracket 821 may be provided with the receiving assembly, and the other side of the straightening rebar receiving bracket 821 may be provided with the positioning assembly.

The receiving assembly may be an assembly for receiving a straightening rebar. In some embodiments, the receiving assembly may include a plurality of single wire feeding wheels 822, a plurality of V-shaped guiding bars 823, a chain driving structure 824, and a sprocket 825.

The single wire feeding wheel 822 may be configured to feed out the straightening rebar.

In some embodiments, a plurality of single wire feeding wheels 822 may be rotationally mounted on the straightening rebar receiving bracket 821 along a length direction of the straightening rebar receiving bracket 821, and a plurality of V-shaped guiding bars 823 may be fixedly connected with the straightening rebar receiving bracket 821 between the plurality of single wire feeding wheels 822. The V-shaped guiding bar 823 may be a bar-shaped assembly for guiding the straightening rebar.

In some embodiments, the sprocket 825 may be fixedly mounted to a side surface of each of the plurality of single wire feeding wheels 822, and the chain driving structure 824 may be mounted on the straightening rebar receiving bracket 821, and a chain of the chain driving structure 824 may engage with all sprockets 825. The chain driving structure 824 may be configured to drive the sprocket 825 to rotate the single wire feeding wheels 822 via the chain to feed out the straightening rebar.

The positioning assembly may be configured to position the straightening rebar. According to some embodiments of the present disclosure, the positioning assembly may include a positioning stopping block 826, a servo linear module 827, and a V-shaped guiding plate 828.

The servo linear module 827 may be configured to convert rotary movement of a servo motor into linear movement to control linear movement of the positioning stopping block 826, and the servo linear module 827 may include a servo motor, a sliding plate, or the like. The positioning stopping block 826 may be configured to block the rebar to position a limit point of a displacement of the rebar. In this embodiment, the servo linear module 827 may be fixedly connected with the straightening rebar receiving bracket 821, the V-shaped guiding plate 828 may be fixedly mounted on the servo linear module 827, and the positioning stopping block 826 may be fixedly mounted on a sliding plate of the servo linear module 827. The V-shaped guiding plate 828 may be a plate-like assembly configured to guide the straightening rebar.

According to some embodiments of the present disclosure, the straightening rebar feeding assembly 830 may include a third cylinder 831, a fourth cylinder 832, and a receiving plate 833.

The third cylinder 831 and the fourth cylinder 832 may be pneumatic actuators for controlling a position of the receiving plate 833. The receiving plate 833 may be a plate-like assembly for receiving and transmitting the straightening rebar. The bending working-station refers to a working-station for bending the straightening rebar. In some embodiments, the third cylinder 831 may be fixedly connected with the frame 801, and an output end of the third cylinder 831 may be fixedly provided with the fourth cylinder 832, and an output end of the fourth cylinder 832 may be fixedly provided with the receiving plate 833.

According to some embodiments of the present disclosure, lengths of hoop bars required for different types of reinforcing meshes may be different, hence a position of the hoop bar during molding and processing may be different. Controlling transverse movement of the positioning stopping block 826 through the servo linear module 827 may enable control of the limit point of the displacement of the rebar. The chain driving structure 824 may drive the single wire feeding wheel 822 to rotate through the sprocket 825, allowing a straightening rebar to move towards the positioning assembly after being cut by the straightening sizer, and ensuring that the straightening rebar does not deviate during the movement through the V-shaped guiding bar 823 and the V-shaped guiding plate 828, until the straightening rebar is blocked by the positioning stopping block 826 and the chain driving structure 824 stops operation, thus ensuring that the straightening rebar stays precisely at a set position for processing accuracy. Subsequently, the output ends of the third cylinder 831 and the fourth cylinder 832 may extend sequentially, allowing the receiving plate 833 to catch the straightening rebar on the single wire feeding wheel 822, then the output ends of the third cylinder 831 and the fourth cylinder 832 may reset, and the receiving plate 833 may transmit the straightening rebar to the bending working-station.

Figure 7:
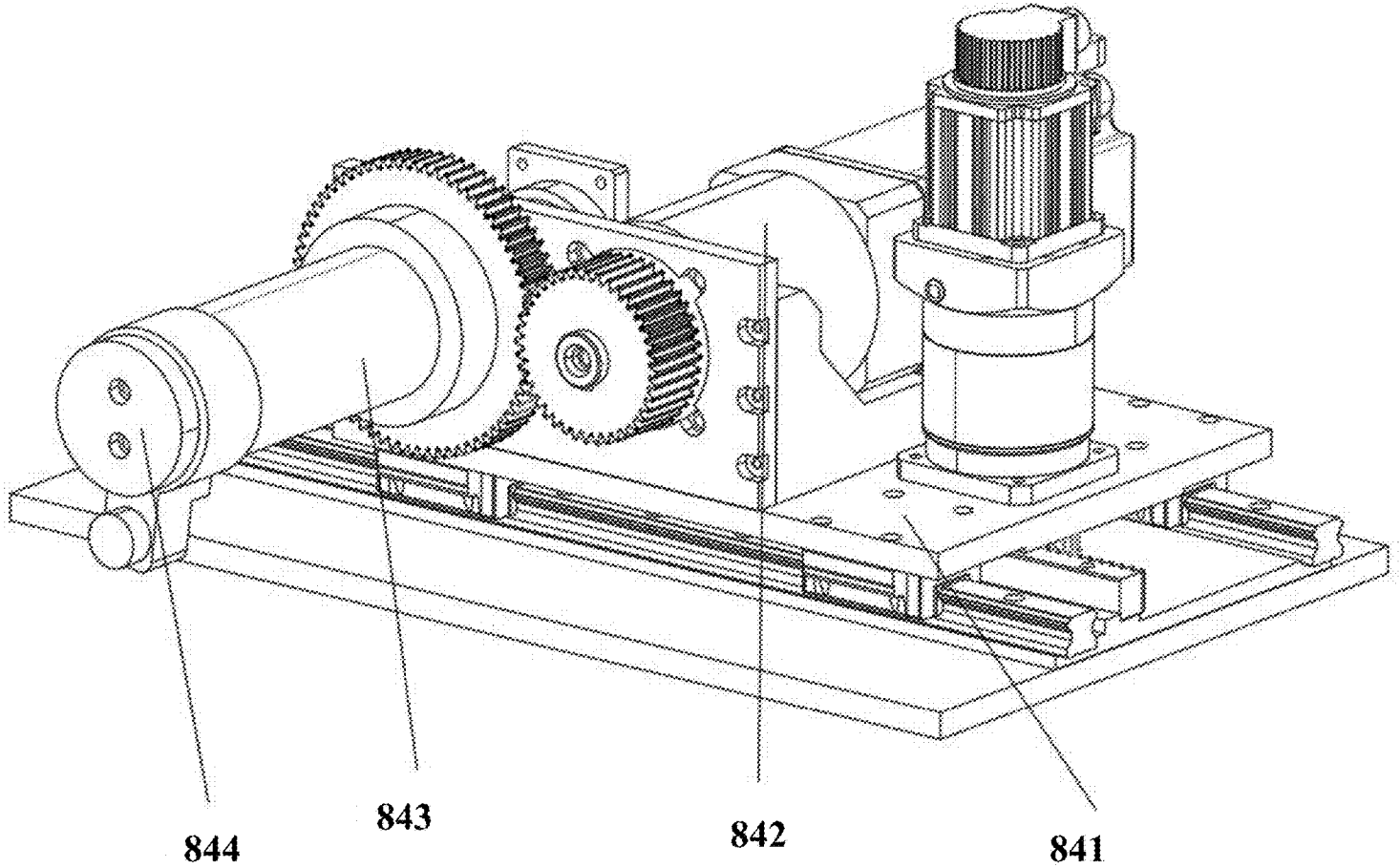
FIG. 7 is a schematic diagram illustrating an exemplary structure of a bending assembly according to some embodiments of the present disclosure.

FIG. 7 is a schematical diagram illustrating an exemplary structure of a bending assembly according to some embodiments of the present disclosure.

As shown in FIG. 7, in some embodiments, the bending assembly 840 may include a transverse servo moving sliding table 841, a servo reduction motor 842, a bending shaft 843, and a bending mold 844.

The transverse servo moving sliding table 841 may be configured to carry and control transverse movement of remaining components of the bending assembly 840. In some embodiments, the transverse servo moving sliding table 841 may be fixedly connected with the frame 801.

In some embodiments, the servo reduction motor 842 may be fixedly mounted on a sliding plate of the transverse servo moving sliding table 841, and the bending shaft 843 may be fixedly mounted on an output end of the servo reduction motor 842, and the bending mold 844 may be fixedly mounted on the bending shaft 843. The servo reduction motor 842 may be an actuating element configured to reduce a rotational speed of a servo motor in the transverse servo moving sliding table 841, and the bending shaft 843 may be a cylindrical assembly configured to bend a straightening rebar, and the bending mold 844 may be configured to bend the straightening rebar into a certain shape.

According to some embodiments of the present disclosure, when the straightening rebar is in place, the servo reduction motor 842 may drive the bending shaft 843 to rotate, and the bending shaft 843 may bend the straightening rebar inward through the bending mold 844, and then the transverse servo moving sliding table 841 may subsequently drive the bending assembly 840 to move inwardly to perform a second bending operation on the straightening rebar, resulting in the straightening rebar being bent into a closed rectangle, thereby forming a hoop bar structure.

In the embodiment of the present disclosure, with the above structure, two sides of a molded hoop bar may have different shapes only by replacing the bending mold 844, thus greatly increasing the scope of application of a molding machine.

Figure 8:
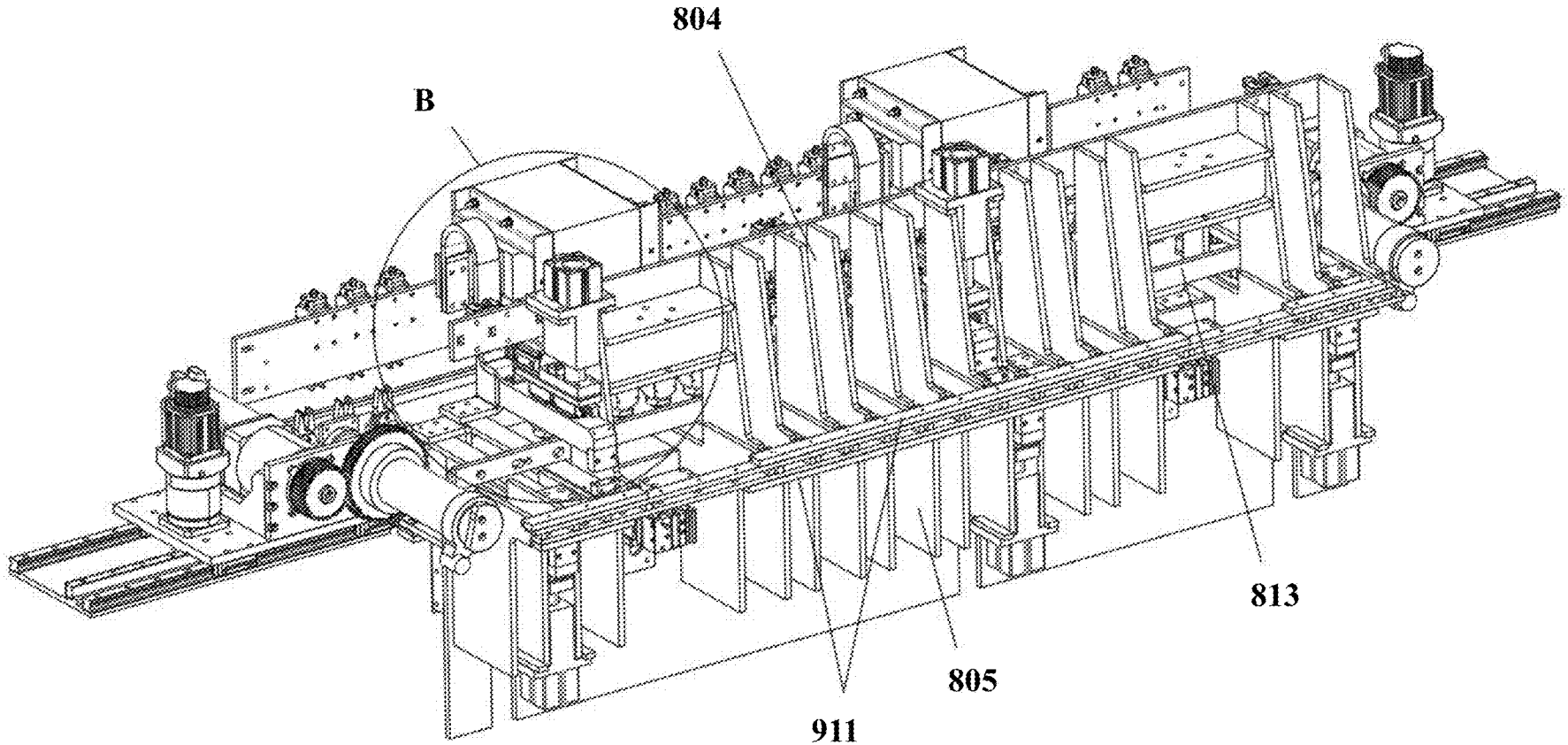
FIG. 8 is a schematic diagram III illustrating an exemplary structure of a molding mainframe according to some embodiments of the present disclosure.
Figure 9:
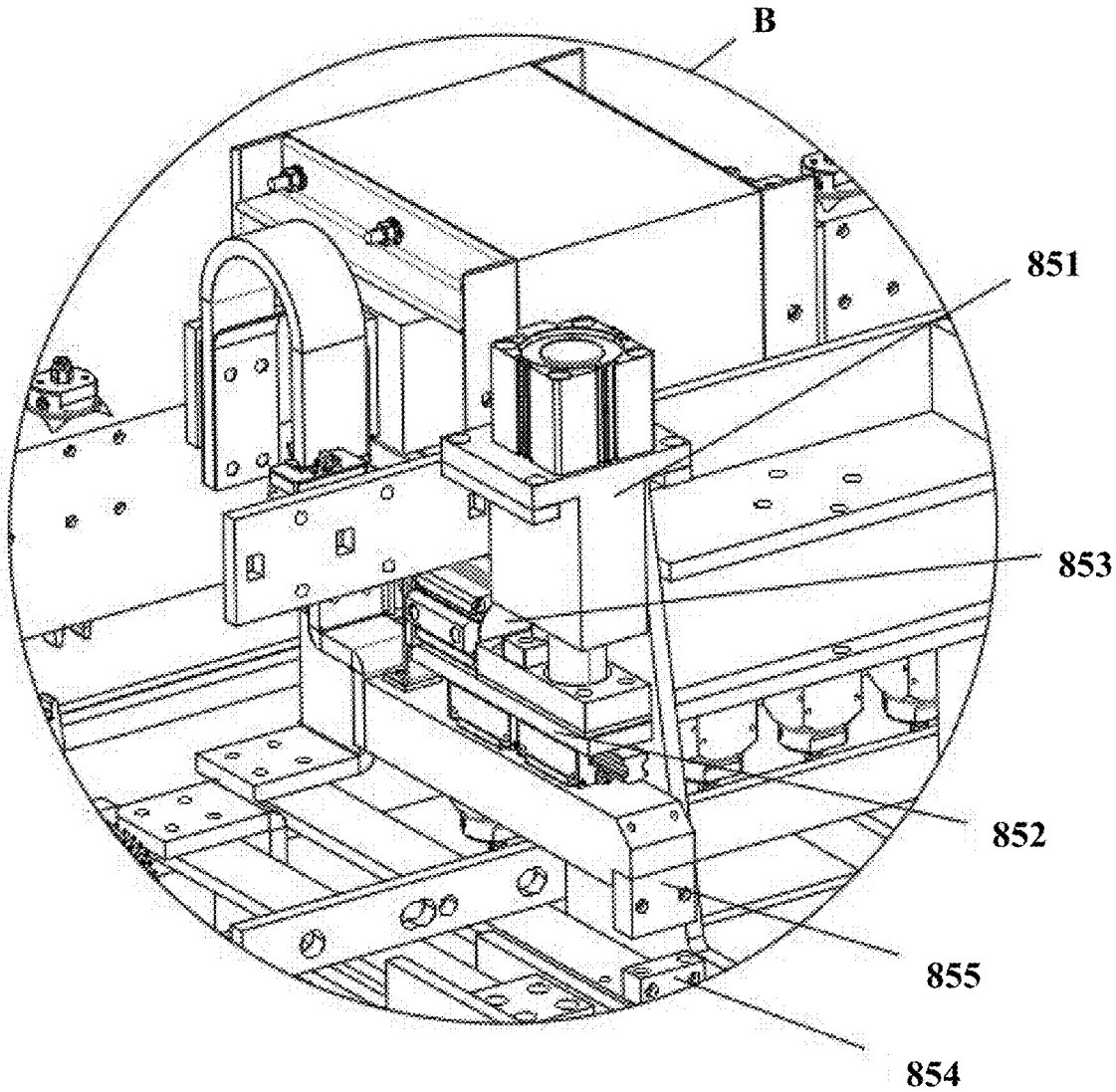
FIG. 9 is a diagram illustrating an enlarged view of a region B in FIG. 8.

FIG. 8 is a schematic diagram III illustrating an exemplary structure of a molding mainframe according to some embodiments of the present disclosure. FIG. 9 is a diagram illustrating an enlarged view of a region B in FIG. 8.

As shown in FIG. 8 and FIG. 9, in some embodiments, the spot welding assembly 850 may include a first cylinder 851, a connecting block 852, a second cylinder 853, a fixed spot welding block 854, and a movable spot welding block 855.

The first cylinder 851 may be a pneumatic actuating element for controlling movement of the fixed spot welding block 854, the connecting block 852 may be a module for connecting the first cylinder 851 and the second cylinder 853, and the second cylinder 853 may be a pneumatic actuating element for resetting the fixed spot welding block 854. In some embodiments, the first cylinder 851 may be fixedly connected with the vertical movable sliding table 803 or the frame 801, and the connecting block 852 may be fixedly mounted to an output end of the first cylinder 851, and the second cylinder 853 may be fixedly mounted on the connecting block 852.

The fixed spot welding block 854 and the movable spot welding block 855 may be modules configured to perform a spot welding on cross nodes of hoop bars and longitudinal bars. In this embodiment, the movable spot welding block 855 may be fixedly mounted at an output end of the second cylinder 853 and the fixed spot welding block 854 may be fixedly connected with the frame 801, and each spot welding assembly 850 may be powered by a separate transformer.

According to some embodiments of the present disclosure, when a straightening rebar is bent, the output end of the second cylinder 853 may contract, so that the movable spot welding block 855 may be in an avoidance state, and when a hoop bar is molded, the second cylinder 853 may drive the movable spot welding block 855 to reset. The first cylinder 851 may drive the movable spot welding block 855 close to the fixed spot welding block 854 and may perform a spot welding on a portion of the cross nodes of the hoop bars and the longitudinal bars to realize the initial molding of a reinforcing mesh.

Figure 10:
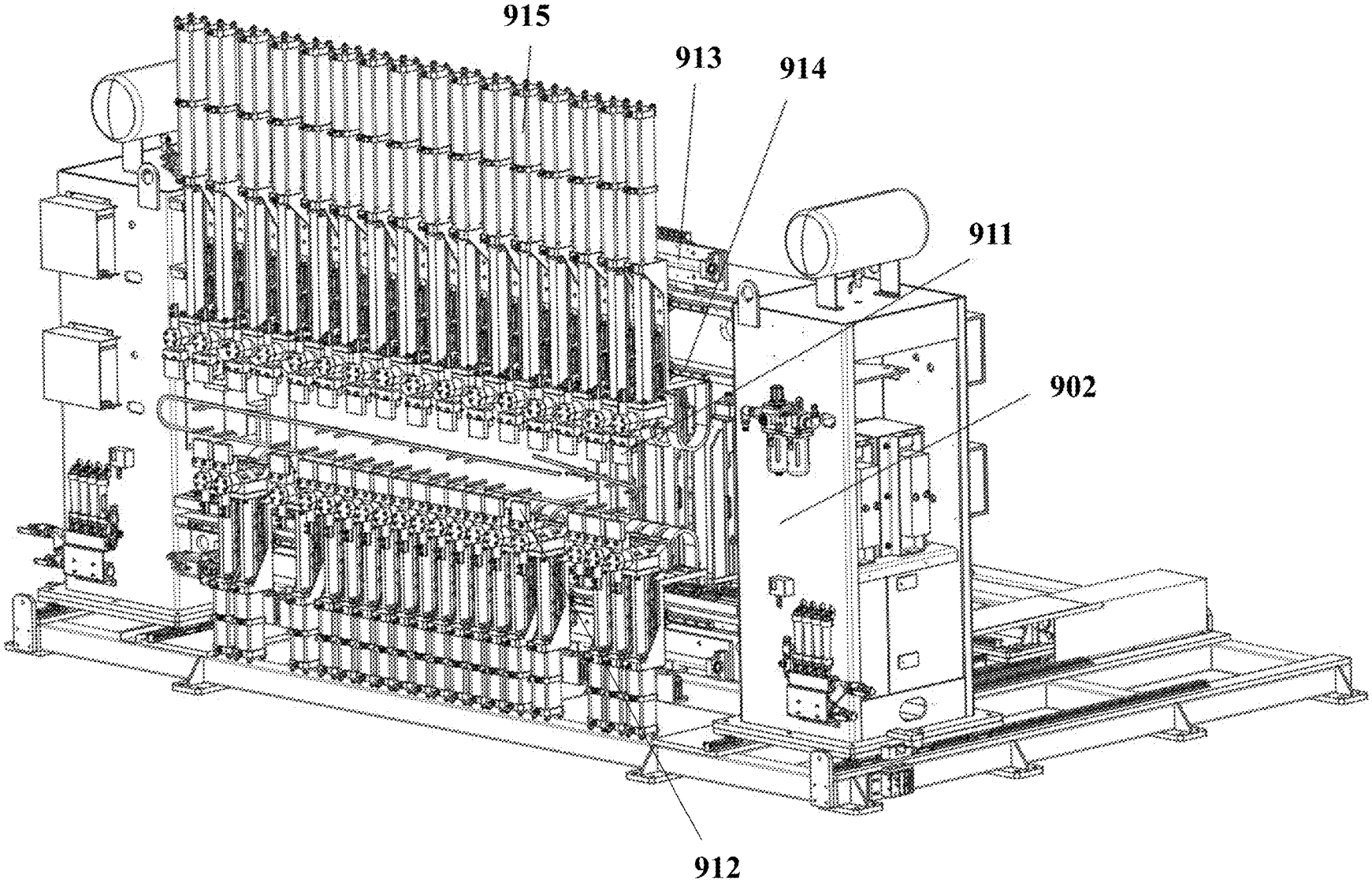
FIG. 10 is a schematic diagram illustrating an exemplary structure of a movable gantry welder according to some embodiments of the present disclosure.

FIG. 10 is a schematic diagram illustrating an exemplary structure of a movable gantry welder according to some embodiments of the present disclosure.

As shown in FIG. 2, FIG. 8, and FIG. 10, in some embodiments, the movable gantry welder 900 may include a first longitudinal servo moving mechanism 901, a gantry frame 902, a second longitudinal servo moving mechanism 903, a wire-clamping assembly 904, and a mounting chassis 905.

The mounting chassis 905 may be an architecture for supporting remaining components of the movable gantry welder 900. In this embodiment, the first longitudinal servo moving mechanism 901 may be fixedly mounted to an inlet end of the mounting chassis 905, and the second longitudinal servo moving mechanism 903 may be fixedly mounted to an outlet end of the mounting chassis 905. The first longitudinal servo moving mechanism 901 may be a mechanism for controlling longitudinal movement of the gantry frame 902. The second longitudinal servo moving mechanism 903 may be a mechanism for controlling longitudinal movement of the wire-clamping assembly 904. In this embodiment, the first longitudinal servo moving mechanism 901 and the second longitudinal servo moving mechanism 903 may include a servo motor, a sliding plate, or the like.

The gantry frame 902 may be an architecture configured to support a portion of components of the row welding assembly 910 to aid in a row welding operation. The wire-clamping assembly 904 may be a component for clamping and moving a reinforcing mesh. In this embodiment, the gantry frame 902 may be fixedly mounted on a sliding plate of the first longitudinal servo moving mechanism 901, and a plurality of wire-clamping assemblies 904 may be fixedly mounted at equal spacing uniformly on a sliding plate of the second longitudinal servo moving mechanism 903.

In some embodiments, the row welding assembly 910 may include a movable row welding block 911, a fixed row welding block 912, a vertical variant assembly 913, a transverse variant assembly 914, and a welding cylinder 915. The movable row welding block 911 and the fixed row welding block 912 may be jointly configured to weld cross nodes of longitudinal bars and hoop bars of an entire row. In some embodiments, the fixed row welding block 912 may be fixedly connected with a right end of the upper support plate 804. Related descriptions of the upper support plate 804 can be found in corresponding description above.

The vertical variant assembly 913, the transverse variant assembly 914, and the welding cylinder 915 may be configured to adjust a position of the movable row welding block 911 for a subsequent row welding operation. In some embodiments, the gantry frame 902 may be fixedly mounted with the vertical variant assembly 913 and the transverse variant assembly 914, and a plurality of welding cylinders 915 may be fixedly connected with a mobile end of the vertical variant assembly 913 and a mobile end of the transverse variant assembly 914 and may be equally spaced apart. An output end of the welding cylinder 915 may be fixedly mounted with the movable row welding block 911, and the movable row welding block 911 may be separated into a plurality of segments to perform a welding operation on a plurality of welding joints in different regions.

According to some embodiments of the present disclosure, the reinforcing mesh after spot welding may be transmitted to an underside of the gantry frame 902, and the welding cylinder 915 may drive the movable row welding block 911 to be close to the fixed row welding block 912, and perform a welding operation on cross nodes of longitudinal bars and hoop bars of an entire row. A spacing between longitudinal bars of an upper layer and a lower layer of different models of reinforcing mesh, a spacing between neighboring longitudinal bars of a same layer, and a spacing between longitudinal bars of two neighboring rows may be different. By adjusting a vertical height of the movable row welding block 911 through the vertical variant assembly 913, the spacing between neighboring movable row welding blocks 911 through the transverse variant assembly 914, and a distance between the gantry frame 902 and the molding mainframe 800 through the first longitudinal servo moving mechanism 901, the row welding assembly 910 may perform a welding operation on different types of reinforcing mesh, greatly increasing the scope of application of a device. After welding is completed, the wire-clamping assembly 904 may drive a right end of a formed mesh to move to the right for a distance, and then a clamping jaw of the wire-clamping assembly 904 may move vertically downward to avoid the mesh, and the wire-clamping assembly 904 may be reset once again to drive the entire mesh to the right for a distance, realizing that with each welding operation, the wire-clamping assembly 904 may drive the molded mesh to move the material progressively.

Some embodiments of the present disclosure provide a molding machine for flexible production of a rebar of bottom, web, and top plates of a precast small box girder, which may include following operations:

Operation 1: a feeding mechanism transporting longitudinal bars of an upper layer and a lower layer arranged in a standardized manner to the frame 801, two rows of the pneumatic clamps 811 clamping and fixing the longitudinal bars of the upper layer and the lower layer, the longitudinal bars of the upper layer penetrating via a plurality of through-holes on the threading guiding plate 813 and being supported and limited by the threading guiding plate 813, and the longitudinal bars of the lower layer being directly supported by the frame 801 and limited by the pneumatic clamp 811.

Operation 2: the chain driving structure 824 driving a plurality of single wire feeding wheels 822 to rotate through a plurality of sprockets 825, and driving a straightening rebar which is cut off by a straightening sizer to be transported under limiting of the V-shaped guiding bar 823 and the V-shaped guiding plate 828 until the straightening rebar is blocked by the positioning stopping block 826.

Operation 3: the third cylinder 831 and the fourth cylinder 832 driving the receiving plate 833 to receive the straightening rebar on the plurality of single wire feeding wheels 822, and then transporting the straightening rebar to a bending working-station.

Operation 4: after the straightening rebar is in place, the servo reduction motor 842 driving the bending shaft 843 to rotate, and the bending shaft 843 bending the straightening rebar inwardly through the bending mold 844, and then the transverse servo sliding table 841 driving a bending assembly to move inwardly to perform a second bending on the straightening rebar, so that the straightening rebar is bent and shaped into a closed rectangle to form a hoop bar structure.

Operation 5: when the straightening rebar is bent, an output end of the second cylinder 853 contracting, so that the fixed spot welding block 854 being in an avoidance state, when the hoop bar structure is formed, the second cylinder 853 driving the fixed spot welding block 854 to reset, and the first cylinder 851 driving the fixed spot welding block 854 to be close to the movable spot welding block 855 to perform a spot welding operation on a portion of cross nodes of hoop bars and longitudinal bars.

Operation 6: the welding cylinder 915 driving the movable row welding block 911 to be close to the fixed row welding block 912, and performing a welding operation on the all cross nodes of longitudinal bars and hoop bars.

Operation 7: with each welding operation, the wire-clamping assembly 904 driving a formed mesh to move forward one operation, then a clamping jaw of the wire-clamping assembly 904 moving vertically downward to avoid the formed mesh and returning to a position of a previous operation, and after a next welding operation, the wire-clamping assembly 904 driving the formed mesh to move forward one operation and progressively advancing the formed mesh out; ultimately, a finished product being either flipped or horizontally transferred out.

Detailed descriptions of the components in the above steps can be found in the corresponding descriptions in the preceding section.

According to some embodiments of the present disclosure, the integrated design of the molding mainframe enables a feeding process, a bending process, and a welding process of the hoop bars to be centralized in a single device. The cooperative work of the molding mainframe and the movable gantry welder can be adjusted for different specifications of reinforcing mesh, realizing the automated flexible production process of a prefabricated reinforcing mesh. Integrating the reinforcing mesh into a single piece makes the production process of three-dimensional reinforcing mesh more efficient, improves the stability of component production, reduces production costs, and meets the needs for multi-specification, safe, efficient, and reliable production.

It should be noted that the foregoing description of steps I through VII is intended to be exemplary and illustrative only and does not limit the scope of application of the present disclosure. For a person skilled in the art, various corrections and changes may be made to step 1 to step 7 under the guidance of the present disclosure. However, these corrections and changes remain within the scope of the present disclosure.

The basic concepts have been described above, and it is apparent to those skilled in the art that the foregoing detailed disclosure is intended as an example only and does not constitute a limitation of the present disclosure. While not expressly stated herein, a person skilled in the art may make various modifications, improvements, and amendments to the present disclosure. Those types of modifications, improvements, and amendments are suggested in the present disclosure, so those types of modifications, improvements, and amendments remain within the spirit and scope of the exemplary embodiments of the present disclosure.

Also, the present disclosure uses specific words to describe embodiments of the present disclosure. Such as "an embodiment", "one embodiment", and/or "some embodiments" means a feature, structure, or characteristic associated with at least one embodiment of the present disclosure. Accordingly, it should be emphasized and noted that "one embodiment" or "an embodiment" or "an alternative embodiment" in different places in the present disclosure do not necessarily refer to the same embodiment. In addition, certain features, structures, or characteristics of one or more embodiments of the present disclosure may be suitably combined.

Additionally, unless expressly stated in the claims, the order of the processing elements and sequences, the use of numerical letters, or the use of other names as described in the present disclosure are not intended to qualify the order of the processes and methods of the present disclosure. While some embodiments of the invention that are currently considered useful are discussed in the foregoing disclosure by way of various examples, it is to be understood that such details serve only illustrative purposes and that additional claims are not limited to the disclosed embodiments, rather, the claims are intended to cover all amendments and equivalent combinations that are consistent with the substance and scope of the embodiments of the present disclosure. For example, although the implementation of various components described above may be embodied in a hardware device, it may also be implemented as a software only solution, e.g., an installation on an existing server or mobile device.

Similarly, it should be noted that in order to simplify the presentation of the disclosure of the present disclosure, and thereby aid in the understanding of one or more embodiments of the invention, the foregoing descriptions of embodiments of the present disclosure sometimes group multiple features together in a single embodiment, accompanying drawings, or in a description thereof. However, this method of disclosure does not imply that more features are required for the objects of the present disclosure than are mentioned in the claims. Rather, claimed subject matter may lie in less than all features of a single foregoing disclosed embodiment.

Some embodiments use numbers to describe the number of components, attributes, and it should be understood that such numbers used in the description of embodiments are modified in some examples by the modifiers "approximately", "nearly", or "substantially". Unless otherwise noted, the terms "approximately", "nearly", or "substantially" indicates that a +20% variation in the stated number is allowed. Correspondingly, in some embodiments, the numerical parameters used in the present disclosure and claims are approximations, which approximations are subject to change depending on the desired characteristics of individual embodiments. For each of the patents, patent applications, patent application disclosures, and other materials cited in the present disclosure, such as articles, books, specification sheets, publications, documents, or the like, their entire contents are hereby incorporated by reference into the present disclosure. Application history documents that are inconsistent with or conflict with the contents of the present disclosure are excluded, as are documents (currently or hereafter appended to the present disclosure) that limit the broadest scope of the claims of the present disclosure.

For each of the patents, patent applications, patent application disclosures, and other materials cited in the present disclosure, such as articles, books, specification sheets, publications, documents, or the like, their entire contents are hereby incorporated by reference into the present disclosure. It should be noted that in the event of any inconsistency or conflict between the descriptions, definitions, and/or use of terms in the materials appended to the present disclosure and those set forth herein, the descriptions, definitions and/or use of terms in the present disclosure shall prevail. Finally, it should be understood that the embodiments described herein are only used to illustrate the principles of the embodiments of the present disclosure.

Other deformations may also fall within the scope of the present disclosure. As such, alternative configurations of embodiments of the present disclosure may be viewed as consistent with the teachings of the present disclosure as an example, not as a limitation. As such, alternative configurations of embodiments of the present disclosure may be viewed as consistent with the teachings of the present disclosure as an example, not as a limitation. Correspondingly, the embodiments of the present disclosure are not limited to the embodiments expressly presented and described herein.

What is claimed is:

1. A molding machine for flexible production of a rebar of bottom, web, and top plates of a precast small box girder, including a molding mainframe and a movable gantry welder disposed on an outlet end of the molding mainframe, wherein the molding mainframe includes a frame, two synchronous lifters, a vertical movable sliding table, a plurality of upper support plates, and a plurality of comb-like support plates, an inlet end of the frame is provided with a longitudinal bar feeding assembly for guiding a longitudinal bar arranged in a standardized manner, the two synchronous lifters are fixedly mounted on an upper side of an outlet end of the frame, the vertical movable sliding table is connected with the frame through a guide rail sliding block structure in a position-limiting and sliding manner, and an output end of the two synchronous lifters are fixedly connected with the vertical movable sliding table, the plurality of upper support plates are fixedly mounted on the vertical movable sliding table at equal spacing, and the plurality of comb-like support plates are fixedly mounted on a lower side of the outlet end of the frame;

the upper side and the lower side of the outlet end of the frame are provided with a plurality of spot welding assemblies for welding a portion of cross nodes of hoop bars and longitudinal bars, and the plurality of spot welding assemblies are connected with the vertical movable sliding table and the frame, respectively, and a straightening rebar receiving assembly is mounted on the lower side of the outlet end of the frame, and a straightening rebar feeding assembly is mounted between the straightening rebar receiving assembly and the frame, the portion of cross nodes is alternating cross nodes of the hoop bars and the longitudinal bars, and a left side and a right side of the frame are provided with a bending assembly, respectively;

two row welding assemblies for welding all cross nodes of the hoop bars and the longitudinal bars are disposed between the molding mainframe and the movable gantry welder, the two row welding assemblies are connected with the plurality of upper support plates and used for welding the longitudinal bars of an upper layer and a lower layer, respectively, and the all cross nodes is all cross nodes of the hoop bars and the longitudinal bars;

the longitudinal bar feeding assembly includes a plurality of pneumatic clamps, a side guiding plate, and a threading guiding plate; two rows of pneumatic clamps of the plurality of pneumatic clamps are fixedly mounted on an upper side and a lower side of the inlet end of the frame, respectively, the two rows of pneumatic clamps are configured to clamp and fix the longitudinal bars of the upper layer and the lower layer that are fed into the longitudinal bar feeding assembly, respectively; the threading guiding plate is fixedly mounted on a lower end of the upper support plate, the threading guiding plate is provided with a plurality of through-holes used for positioning the longitudinal bars of the upper layer, and the longitudinal bars of the lower layer are directly supported through the frame; and the lower side of the inlet end of the frame is fixedly provided with a plurality of groups of side guiding structures for guiding the longitudinal bars of the lower layer, each group of the plurality of groups of the side guiding structures being made of two side guiding plates, an inlet end of the two side guiding plates being provided with an opening that facilitates entry of the longitudinal bars of the lower layer.

2. The molding machine of claim 1, wherein the straightening rebar receiving assembly includes a straightening rebar receiving bracket, a receiving assembly, and a positioning assembly, the straightening rebar receiving bracket being fixedly mounted on the lower side of the outlet end of the frame, a first side of the straightening rebar receiving bracket is mounted with the receiving assembly, and a second side of the straightening rebar receiving bracket is mounted with the positioning assembly.

3. The molding machine of claim 2, wherein the straightening rebar receiving assembly includes a plurality of single wire feeding wheels, a plurality of V-shaped guiding bars, a chain driving structure, and a plurality of sprockets, the plurality of single wire feeding wheels are rotationally mounted on the straightening rebar receiving bracket along a length direction of the straightening rebar receiving bracket, the plurality of V-shaped guiding bars that are fixedly connected with the straightening rebar receiving bracket are disposed between the plurality of single wire feeding wheels; a side surface of each of the plurality of single wire feeding wheels is mounted with one of the plurality of sprockets, the chain driving structure is mounted on the straightening rebar receiving bracket, and a chain of the chain driving structure is engaged with the plurality of sprockets.

4. The molding machine of claim 3, wherein the positioning assembly includes a positioning stopping block, a servo linear module, and a V-shaped guiding plate, the servo linear module being fixedly connected with the straightening rebar receiving bracket, the V-shaped guiding plate being fixedly mounted on the servo linear module, and the positioning stopping block being fixedly mounted on a sliding plate of the servo linear module.

5. The molding machine of claim 4, wherein the bending assembly includes a transverse servo moving sliding table, a servo reduction motor, a bending shaft, and a bending mold, the transverse servo moving sliding table is fixedly connected with the frame, the servo reduction motor is fixedly mounted on a sliding plate of the transverse servo moving sliding table, the bending shaft is fixedly mounted on an output end of the servo reduction motor, and the bending mold is fixedly mounted on the bending shaft.

6. The molding machine of claim 5, wherein each of the plurality of spot welding assemblies includes a first cylinder, a connecting block, a second cylinder, a fixed spot welding block, and a movable spot welding block, the first cylinder is fixedly connected with the vertical movable sliding table or the frame, the connecting block is fixedly mounted at an output end of the first cylinder, the connecting block is fixedly mounted with the second cylinder, and the fixed spot welding block is fixedly mounted at an output end of the second cylinder; the movable spot welding block is fixedly connected with the frame; and each of the plurality of spot welding assemblies is powered by a separate transformer.

7. The molding machine of claim 6, wherein the movable gantry welder includes a first longitudinal servo moving mechanism, a gantry frame, a second longitudinal servo moving mechanism, a plurality of wire-clamping assemblies, and a mounting chassis, the first longitudinal servo moving mechanism is fixedly mounted on an inlet end of the mounting chassis, the second longitudinal servo moving mechanism is fixedly mounted on an outlet end of the mounting chassis, the gantry frame is fixedly mounted on a sliding plate of the first longitudinal servo moving mechanism, and the plurality of wire-clamping assemblies are fixedly mounted at equal spacing on a sliding plate of the second longitudinal servo moving mechanism uniformly.

8. The molding machine of claim 7, wherein each of the two row welding assemblies includes a movable row welding block, a fixed row welding block, a vertical variant assembly, a transverse variant assembly, and a welding cylinder, the fixed row welding block is fixedly connected with a right end of the upper support plate; the vertical variant assembly and the transverse variant assembly are fixedly mounted on the gantry frame, and the welding cylinder is fixedly connected with a mobile end of the vertical variant assembly and a mobile end of the transverse variant assembly and are equally spaced apart; an output end of the welding cylinder is fixedly provided with the fixed row welding block; and the fixed row welding block is separated into a plurality of segments to perform a welding operation on a plurality of welding joints in different regions.

9. A method for using the molding machine of claim 8, comprising:

operation 1: a feeding mechanism transporting the longitudinal bars of the upper layer and the lower layer arranged in a standardized manner to the frame, the two rows of pneumatic clamps clamping and fixing the longitudinal bars of the upper layer and the lower layer, the longitudinal bars of the upper layer penetrating via the plurality of through-holes on the threading guiding plate and being supported and limited by the threading guiding plate; the longitudinal bars of the lower layer being directly supported by the frame and being limited by the pneumatic clamps;

operation 2: the chain driving structure driving the plurality of single wire feeding wheels to rotate through the plurality of sprockets, and driving the straightening rebar which is cut off by a straightening sizer to be transported under limiting of the V-shaped guiding bar and the V-shaped guiding plate until the straightening rebar is blocked by the positioning stopping block;

operation 3: a third cylinder and a fourth cylinder driving a receiving plate to receive the straightening rebar on the plurality of single wire feeding wheels, and then transporting the straightening rebar to a bending working-station;

operation 4: after the straightening rebar is in place, the servo reduction motor driving the bending shaft to rotate, and the bending shaft bending the straightening rebar inwardly through the bending mold, and then the transverse servo moving sliding table driving the bending assembly to move inwardly to perform a second bending on the straightening rebar, so that the straightening rebar is bent and shaped into a closed rectangle to form a hoop bar structure;

operation 5: when the straightening rebar is bent, an output end of the second cylinder contracting, so that the fixed spot welding block is in an avoidance state, when the hoop bar structure is formed, the second cylinder driving the fixed spot welding block to reset, and the first cylinder driving the fixed spot welding block to be close to the movable spot welding block to perform a spot welding operation on the portion of cross nodes of the hoop bars and the longitudinal bars;

operation 6: the welding cylinder driving the movable row welding block to be close to the fixed row welding block, and performing a welding operation on the all cross nodes of the hoop bars and the longitudinal bars; and operation 7: with each welding operation, the wire-clamping assembly driving a formed mesh to move forward one operation, then a clamping jaw of the wire-clamping assembly moving vertically downward to avoid the formed mesh and returning to a position of a previous operation, and after a next welding operation, the wire-clamping assembly driving the formed mesh to move forward one operation and progressively advancing the formed mesh out; ultimately, a finished product being either flipped or horizontally transferred out.

* * * * *